US005424178A

United States Patent [19]

Tsuzuki

[11] Patent Number: 5,424,178

[45] Date of Patent: Jun. 13, 1995

[54] SILVER HALIDE PHOTOGRAPHIC MATERIAL

[75] Inventor: Hirohiko Tsuzuki, Kanagawa, Japan

[73] Assignee: Fuji Photo Film Co., Ltd., Kanagawa, Japan

[21] Appl. No.: 217,055

[22] Filed: Mar. 24, 1994

[30] Foreign Application Priority Data

Mar. 25, 1993 [JP] Japan ..... 5-066824

[51] Int. Cl.[6] ..... G03C 1/76

[52] U.S. Cl. ..... 430/523; 430/961; 430/950; 430/603; 430/611; 430/567

[58] Field of Search ..... 430/523, 961, 950, 603, 430/611, 567

[56] References Cited

U.S. PATENT DOCUMENTS 4,439,520 3/1984 Kofron et al. ..... 430/434
4,711,838 12/1987 Grzeskowiak et al. ..... 430/523
4,828,971 5/1989 Przezdziecki ..... 430/523
5,206,127 4/1993 Ishigaki et al. ..... 430/523
5,310,640 5/1994 Markin et al. ..... 430/523

FOREIGN PATENT DOCUMENTS 0158845 7/1991 Japan .

*Primary Examiner*—Thomas R. Neville
*Attorney, Agent, or Firm*—Sughrue, Mion, Zinn, Macpeak & Seas

[57] ABSTRACT

A silver halide photographic material is disclosed, comprising at least one silver halide emulsion layer on a support and a backing layer on the surface of the support opposite to the emulsion layer, wherein said silver halide emulsion layer comprises tabular grains having an aspect ratio of not less than 3 in a proportion of not less than 50% as calculated in the terms of projected area of the silver halide grains contained in the emulsion layer and the surface on the backing layer side has a Beck smoothness of not more than 150 seconds.

5 Claims, No Drawings

SILVER HALIDE PHOTOGRAPHIC MATERIAL

FIELD OF THE INVENTION

The present invention relates to a silver halide photographic material which is suitable for rapid processing. Firstly, the present invention relates to a photographic material for taking pictures on a CRT (Cathode Ray Tube) (hereinafter referred to as "CRT photographic material") and more particularly to a single-sided light-sensitive photographic material comprising the CRT photographic material which can provide a highly sharp image quality and hence a faithful reproduction of a CRT display image. Secondly, the present invention relates to a single-sided photographic material which can provide a high sensitivity and an excellent graininess and sharpness to give a photographic material which is most suitable for photographing breast, appendicular skeleton, etc. in a fluorescent sensitizing screen or fluorescent screen system for X-ray photographing.

BACKGROUND OF THE INVENTION

With the recent remarkable development of medical electronics, remarkable progress has been made in novel diagnoses by ME apparatus such as CR (computer radiography), CT (computer tomography), US (ultrasonic diagnosis), RI (radioisotopic medicine) and thermography.

Unlike the conventional diagnostic process for directly obtaining a picture on X-ray photographic material, these diagnoses comprise outputting various measurements to a display from which a medical doctor can make a diagnosis. In the most actual diagnosis, however, a medical doctor does not only make a diagnosis from the display but also takes a picture on a recording material such as X-ray photographic material which will be developed for subsequent re-diagnosis in another place at another time. It has thus been desired to provide CRT photographic materials which can provide a faithful reproduction of a CRT display.

High temperature rapid processing has suddenly become popular in the process for the development of photographic materials. Thus, the time required for various photographic materials to be processed in an automatic developing machine has been extremely reduced. This rapid processing requires that a developer which can accomplish sufficient sensitivity in a short period of time be used and the photographic material used exhibits film properties such that it shows a rapid progress of development, provides a sufficient degree of blackening in a short period of time and dries in a short period of time after rinsing.

A typical approach for improving the dryability of the photographic materials comprises adding a sufficient amount of a hardening agent (gelatin crosslinking agent) during the coating step so that the emulsion layer or hydrophilic colloidal layer exhibits a reduced swell in the subsequent development, fixing and rinsing steps, resulting in the reduction of the water content in the photographic material before the beginning of drying. In accordance with this approach, the more the amount of hardening agent added, the shorter is the drying time. However, the reduction of the swell of the photographic material in the developer retards the progress of development, lowers the sensitivity and covering power and gives a low contrast. Further, the reduction of the swell of the photographic material in the fixing solution retards the progress of fixing, causing many troubles such as residual silver, residual hypo, residual color of sensitizing dye and worsened susceptibility to roller marks. These troubles impede the reduction of processing time.

On the other hand, in order to enhance the activity of the processing solution, it is effective to increase the content of developing agent or auxiliary developing agent in the developer and raise the pH value and the temperature of the developer. However, all these approaches deteriorate the storage stability of the processing solution, lower the contrast of image and increase fog. In order to solve these problems, it is effective to incorporate a mercapto-containing compound in the photographic material. However, this approach is disadvantageous in that it lowers the sensitivity and contrast, deteriorates the fixability and pressure properties (i.e., resistance to damage by pressure) and worsens the susceptibility to roller marks.

A technique for utilizing tabular grains for the purpose of providing adaptability to rapid processing is described in U.S. Pat. Nos. 4,439,520 and 4,425,425. JP-A-58-111933 (The term "JP-A" as used herein means an "unexamined published Japanese patent application") discloses a photographic element for radiography which comprises tabular grains to reduce the swelling ratio of the hydrophilic colloidal layer to not more than 200% to give a high covering power without adding a hardening agent during processing. Further, JP-A-63-305343 and JP-A-1-77047 disclose a technique for improving the development progress and the sensitivity/fog ratio by controlling the development starting point of silver halide grains having 111 plane to the apex and/or edge thereof and its vicinity. These known techniques are very useful methods for improving the development progress of photographic materials.

In order to obtain silver halide grains which give sufficient degree of blackening in a period of time as short as not less than 10 seconds by utilizing the foregoing techniques, a large amount of a substance which is adsorbed by silver halide, such as spectral sensitizing dye, is needed for controlling the development starting point. However, these adsorptive substances deteriorate the fixability and pressure properties and worsens the susceptibility to roller marks.

Moreover, since the automatic developing machine adapted for rapid processing essentially needs a high speed conveyance for enhancing the processing capacity, it is required that the photographic material can be easily peeled off each other and the photographic material exhibits an improved smoothness during the conveying step. On the other hand, these properties can be effectively improved by increasing the grain diameter of the matting agent. However, if the grain diameter of the matting agent on the light-sensitive layer side of a photographic material having an emulsion layer on a single side thereof such as the material for a medical CRT display is increased, the matting agent is fallen out or sinks in the film which has been developed, causing star dust-like light leak in the area uniformly irradiated with light. A typical conventional approach for avoiding such troubles is to increase the grain diameter of the matting agent on the backing layer side alone. However, a photographic material comprising matting agent grains having an increased diameter on the backing layer side can not only easily slide with but also vigorously rub against the emulsion side of another during its transportation, making the rubbed portion susceptible to desensitization or blackening (so-called abrasion or scratch). In particular, desensitization can look a focus that leads to an erroneous diagnosis which possibly results in a serious damage to both medical doctor and patient. Thus, it is difficult to improve the peelability of photographic material.

SUMMARY OF THE INVENTION

An object of the present invention is to provide a photographic material which can easily be conveyed and is insusceptible to abrasion even in rapid processing.

The object of the present invention is accomplished with a silver halide photographic material comprising at least one silver halide emulsion layer on a support and a backing layer on the surface of the support opposite to the emulsion layer, wherein said silver halide emulsion layer comprises tabular grains having an aspect ratio of not less than 3 in a proportion of not less than 50% as calculated in terms of projected area of the silver halide grains contained in the emulsion layer and the surface of the backing layer side has a Beck smoothness of not more than 150 seconds.

DETAILED DESCRIPTION OF THE INVENTION

The present invention is described in detail hereinafter.

The silver halide photographic material constituting the photographic material unit according to the present invention is a so-called single-sided light-sensitive material comprising at least one silver halide emulsion layer on one side thereof and a backing layer on the other side.

The matting degree of the backing side of the photographic light-sensitive material can be represented by the Beck smoothness, and the Beck smoothness is not more than 150 seconds, preferably not more than 120 seconds, more preferably from 30 to 120 seconds, in the present invention.

The terminology "matting degree" as used herein means the degree of so-called "surface roughness". The surface roughness is roughness due to surface unevenness over a short span. The surface roughness is a measure of the sense of touch which is perceived "slippery" or "rough". The matting degree can be determined by various measuring methods such as observation of surface conditions by means of surface roughness meter, optical microscope, scanning electron microscope, etc. A typical measure of average surface roughness is the Beck smoothness described in JIS P 8119. The Beck smoothness is represented by the time in seconds required for 10 ml of air to flow under a differential pressure of 370 mmHg through a gap between the specimen and a flat plate pressed against the surface of the specimen (effective area: 10 $cm^2$) to be tested at a pressure of 1 $kg/cm^2$ In other words, the more the flow time is in seconds, the less is the matting degree. The less the flow time is in seconds, the more is the matting degree. In order to accurately measure the Beck smoothness, an air micrometer type tester is preferably used. In particular, the Ouken type smoothness measuring method described in J. TAPPI (Japan Technical Association of the Pulp And Paper Industry's paper pulp testing method No. 5 can be used to provide a highly reproducible easy measurement of the Beck smoothness) (see Yamamoto et al., "J. TAPPI Journal", 20[2], pp. 17–24, 1966).

The emulsion layer side of the photographic material may exhibit an arbitrary matting degree so far as no star dust-like light leak occurs and is preferably not less than 1,000 seconds, particularly preferably not less than 2,000 seconds as calculated in terms of Beck smoothness.

In general, a matting agent is used to provide a photographic material with a degree of mat+ting. The matting agent normally comprises finely divided grains of a water-insoluble organic or inorganic compound. As such a matting agent, any matting agent known in the art can be used. Examples of the matting agent include organic matting agents described in U.S. Pat. Nos. 1,939,213, 2,701,245, 2,322,037, 3,262,782, 3,539,344 and 3,767,448, and inorganic matting agents described in U.S. Pat. Nos. 1,260,772, 2,192,241, 3,257,206, 3,370,951, 3,523,022 and 3,769,020.

Specific examples of organic compounds which can be used as the matting agents include water-dispersible vinyl polymers such as polymethyl acrylate, polymethyl methacrylate, polyacrylonitrile, acrylonitrile-$\alpha$-methylstyrene copolymer, polystyrene, styrene-divinylbenzene copolymer, polyvinyl acetate, polyethylene carbonate and polytetrafluoroethylene; cellulose derivatives such as methyl cellulose, cellulose acetate and cellulose acetate propionate; starch derivatives such as carboxy starch, carboxynitrophenyl starch and urea-formaldehyde-starch reaction product; gelatin hardened with a known hardener; and hardened gelatin in the form of coacervation-hardened hollow microcapsule grain. Specific examples of inorganic compounds include silicon dioxide, titanium dioxide, magnesium dioxide, aluminum oxide, barium sulfate, calcium carbonate, silver chloride desensitized by a known method, silver bromide desensitized by a known method, glass, and diatomaceous earth. The foregoing matting agent may be used in admixture with different kinds of substances as necessary.

The size and shape of matting grains is not specifically limited. The grain diameter of matting grains may be arbitrary. In the implementation of the present invention, matting grains having a grain diameter of 0.1 $\mu m$ to 30 $\mu m$ (particularly preferably from 6 $\mu m$ to less than 12 $\mu m$) can be preferably used. The grain diameter of the matting agent is represented by average diameter weighted by volume using an electron microscope and the coulter counter. The grain diameter distribution of the matting agent may be narrow or wide.

On the other hand, the matting agent extremely influences the haze and surface gloss of the photographic material. Therefore, the grain diameter, shape and grain diameter distribution of the matting agent are preferably adjusted to the desired range by properly controlling the preparation conditions of the matting agent or by mixing a plurality of matting agents.

In the present invention, the matting agent can be preferably incorporated in the outermost layer, a layer which functions as an outermost layer or a layer close to the outer surface in the photographic material. Alternatively, the matting agent can be preferably incorporated into a layer which functions as a so-called protective layer.

Gelatin to be incorporated in the backing layer of the present invention is lime-treated gelatin, acid-treated gelatin or enzyme-treated gelatin which may be partially replaced by a synthetic or natural high molecular compound. The amount of gelatin used is preferably not more than 4.0 g per $m^2$ of the photographic material. If gelatin is used in an excessive amount, the photographic material does not only exhibit a worsened dryability in the automatic developing machine but also may suffer from poor dye clearing property. Gelatin may comprise finely divided grains of an inorganic material such as colloidal silica or an organic plasticizer such as ethylacrylate/acrylic acid copolymer incorporated therein as a film property improver.

The backing layer of the present invention may have an overcoating layer provided thereon. By providing such an overcoating layer, dye transfer, dye oozing, etc. can be improved. The overcoating layer may be coated in two or more separate layers. The backing layer and the overcoating layer may be preferably coated at the same time.

Examples of surface active agents which can be used in the present invention include natural surface active agents such as saponin; nonionic surface active agents such as alkylene oxide, glycerin and glycidol; cationic surface active agents such as higher alkylamine, quaternary ammonium salt, phosphonium and sulfonium; anionic surface active agents such as carboxylic acid; sulfonic acid, phosphoric acid and sulfuric acid ester; amphoteric surface active agents such as amino acid, aminosulfonic acid and aminoalcohol ester; and fluorine surface active agents obtained by partially substituting these surface active agents with fluorine or alkyl.

As the silver halide employable in the silver halide emulsion, any of silver halide may be used, such as silver bromochloride, silver bromide, silver bromoiodide and silver bromochloroiodide. The silver halide which can be used in the present invention preferably has an iodide content of not more than 1% per mol of silver. The AgI distribution of the silver halide emulsion may be either an internal high AgI concentration grain emulsion or a surface high AgI concentration grain emulsion.

The formation or physical ripening of silver halide grains may be effected in the presence of a cadmium salt, zinc salt, lead salt, thallium salt, iridium salt or its complex salt, rhodium salt or its complex salt, iron salt or its complex salt or the like. If necessary, the silver halide emulsion may be subjected to chemical sensitization.

The silver halide grains which can be used in the silver halide emulsion need to be tabular for the most part. The proportion of tabular grains in the silver halide grains is not less than 50%, preferably not less than 70% of silver halide grains contained in the emulsion layer as calculated in terms of projected area. The aspect ratio of tabular grains can be given by the ratio of the diameter of the circle having the same area as the projected area of individual tabular grain to the thickness of individual tabular grain. The tabular grains according to the present invention need to comprise grains having an aspect ratio of not less than 3 in a proportion of not less than 50%, preferably those having an aspect ratio of not less than 4 in a proportion of not less than 50%. The average aspect ratio of the tabular silver halide grains is preferably from not less than 3 to less than 20, more preferably from not less than 4 to less than 10. Further, the average thickness of the tabular silver halide grains is preferably not more than 0.3 μm, particularly preferably not more than 0.2 μm.

The preparation of the tabular silver halide (grain) emulsion according to the present invention can be easily obtained by the method as described in JP-A-58-127927, JP-A-58-113927, and JP-A-58-113928. Alternatively, the tabular silver halide (grain) emulsion according to the present invention can be obtained by a process which comprises forming seed crystals comprising tabular grains in a proportion (by weight) of not less than 40% in an atmosphere having a relatively low pBr value of not more than 1.3, and then adding silver and a halogen solution to the seed crystals at the same time while the pBr value being kept at the same value to allow the seed crystals to grow. Silver and a halogen solution are preferably added to the system during the growth procedure so that new crystalline nuclei cannot be generated. The size of the tabular silver halide grains can be adjusted by properly controlling the temperature and rate at which the silver salt and halide are added during the grain growth and selecting the kind and amount of the solvent to be used.

The emulsion layer according to the present invention preferably comprises a thiocyanic compound in an amount of from not less than $1.0\times10^{-3}$ mol to less than $2.0\times10^{-2}$ per mol of the silver. The addition of the thiocyanic compound may be effected in any procedure such as grain formation, physical ripening, grain growth, chemical sensitization and coating, preferably before chemical sensitization.

As the thiocyanic compound to be used in the preparation of the silver halide emulsion according to the present invention, a water-soluble salt such as metal thiocyanate and ammonium thiocyanate can be generally used. However, if a metal thiocyanate is used, care should be taken to use a metal element that gives no adverse effect on the photographic properties. Preferably potassium or sodium can be used as the metal element. Alternatively, a difficultly soluble salt such as AgSCN may be added in the form of finely divided grains. In this case, the diameter of finely divided grains of AgSCN is preferably not more than 0.2 μm, particularly preferably not more than 0.05 μm.

The silver halide emulsion to be used in the present invention may be subjected to chemical sensitization. Examples of such a chemical sensitization method which can be used in the present invention include sulfur sensitization, selenium sensitization, tellurium sensitization, reduction sensitization using complex salt, polyamine, etc., gold sensitization using gold compound, and sensitization using a metal such as iridium, platinum, rhodium and palladium. These chemical sensitization methods may be used in combination as necessary.

In particular, sulfur sensitization using sulfur-containing compound, selenium sensitization using selenium-containing compound, and tellurium sensitization using tellurium-containing compound are preferably effected; singly or in combination, in the presence of a compound which can be adsorbed to silver halide. The term "compound which can be adsorbed to silver halide" as used herein means a spectral sensitizing dye or photographic stabilizer. As such the compound, a compound as disclosed in JP-A-63-305343 and JP-A-1-77047 can be used.

The silver halide emulsion to be used in the present invention is preferably subjected to spectral sensitization. The kind of sensitizing dye to be used can be properly selected depending on the desired exposure conditions. For CRT photographic materials, an orthochromatic sensitizing dye is preferably used. Such a sensitizing dye may be added in any procedure during the preparation of the photographic material, preferably before the addition of the chemical sensitizer.

The content of silver in the photographic material according to the present invention is preferably in the range of 0.5 to 5 g/m$^2$ (per single side), more preferably 1.4 to 3.2 g/m$^2$ (per single side).

The adaptability to rapid processing is preferably not more than 5 g/m$^2$.

The at least one layer (preferably the hydrophilic colloidal layer) which is present on the light-sensitive emulsion layer side of the photographic material according to the present invention preferably comprises a compound represented by formula (I):

(I)

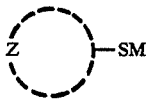

wherein Z represents a heterocyclic ring directly or indirectly having at least one group selected from the group consisting of —$SO_3M$, —COOM, —$CONHR^1$, —$SO_2NHR^22$, —OH and —$NHR^3$ (wherein $R^1$, $R^2$ and $R^3$, each represents a hydrogen atom, an alkyl group having 1 to 6 carbon atoms, —$COR^4$, —$COOR^4$ or —$SO_2R^4$ (wherein $R^4$ represents a hydrogen atom, an aliphatic group or an aromatic group)); and M represents a hydrogen atom, an alkaline metal atom or a quaternary ammonium group or a protective group which is released under an alkaline condition.

The compound represented by formula (I) is further described in detail hereinafter.

In formula (I), Z represents a heterocyclic ring directly or indirectly having at least one group selected from the group consisting of —$SO_3M$, —COOM, —$CONHR^1$, —$SO_2NHR^2$, —OH and —$NHR^3$, and M represents a hydrogen atom, an alkaline metal atom (e.g., sodium, potassium) or a quaternary ammonium group (e.g., trimethylammonium, dimethylbenzylammonium, tributylammonium) or a protective group which is released under an alkaline condition (e.g., acetyl, cyanoethyl, methanesulfonyl). $R^1$, $R^2$ and $R^3$, each represents a hydrogen atom, a straight-chain or branched alkyl group having 1 to 6 carbon atoms (e.g., methyl, propyl, hexyl, isopropyl), —$COR^4$, —$COOR^4$ or —$SO_2R^4$ (wherein $R^4$ represents a hydrogen atom or a straight-chain or branched aliphatic group (e.g., alkyl, alkylene, alkyne) or an aromatic group (e.g., phenyl, naphthyl) which may be substituted. The examples of substituents which may be substituted to the aliphatic group or aromatic group include a halogen atom, a carboxyl group, an acyl group, a sulfonic acid group, a sulfonamide group, a sulfamoyl group, an amino group and an alkylamino group.

Specific examples of the compound represented by formula (I) which can be used in the present invention is given below, but the present invention should not be construed as being limited thereto.

(1)

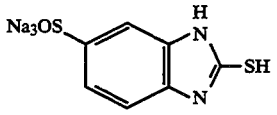

(2)

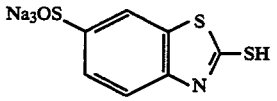

-continued (3)

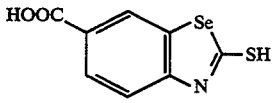

(4)

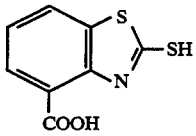

(5)

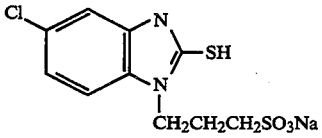

(6)

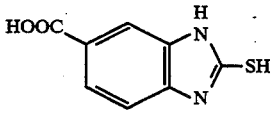

(7)

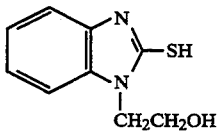

(8)

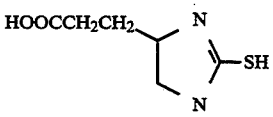

(9)

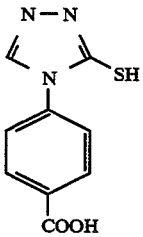

(10)

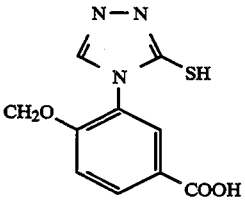

(11)

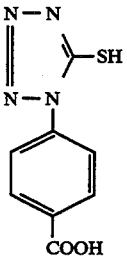

-continued
(12)
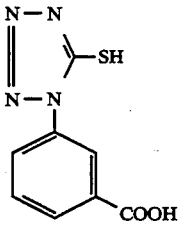
(13)
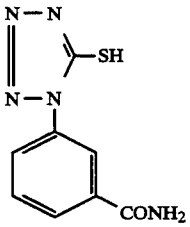
(14)
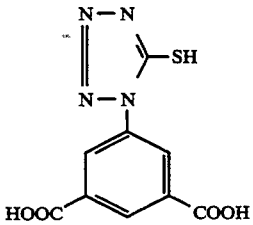
(15)
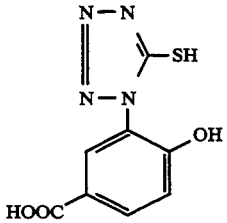
(16)
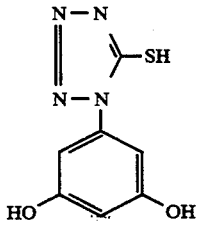
(17)
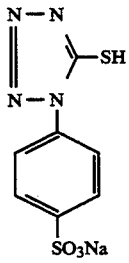
(18)
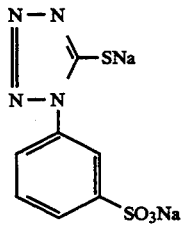
-continued
(19)
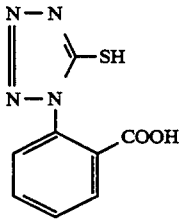
(20)
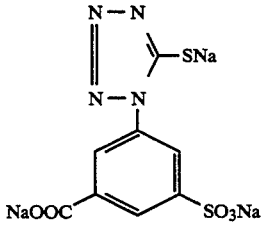
(21)
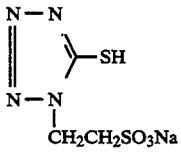
(22)
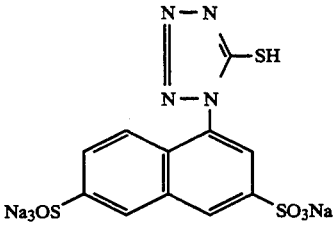
(23)
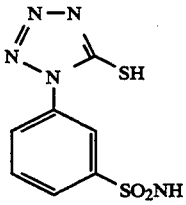
(24)
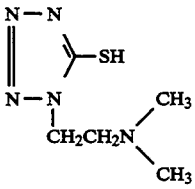
(25)
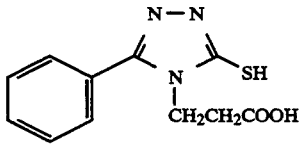

-continued
(26)
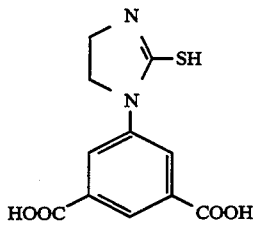
(27)
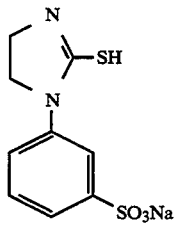
(28)
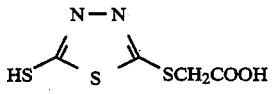
(29)
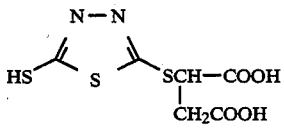
(30)
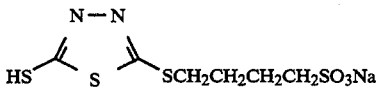
(31)
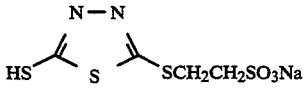
(32)
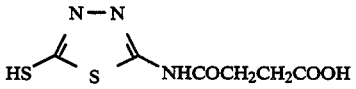
(33)
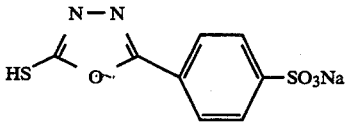
(34)
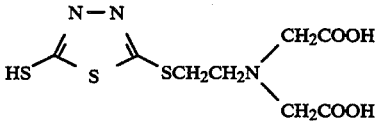
(35)
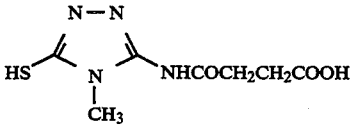
(36)
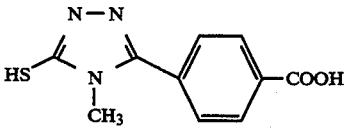
-continued
(37)
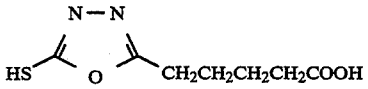
(38)
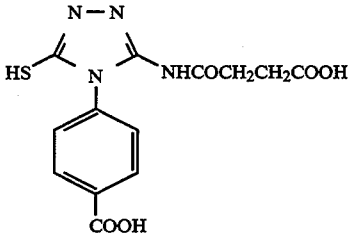
(39)
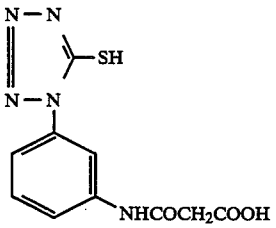
(40)
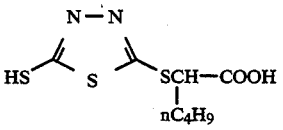
(41)
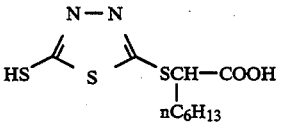
(42)
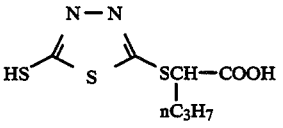
(43)
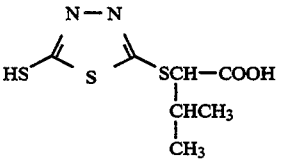
(44)
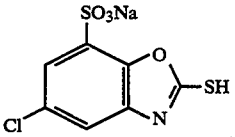
(45)
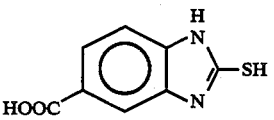
(46)
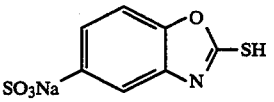

-continued (47)

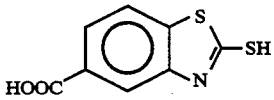

(48)

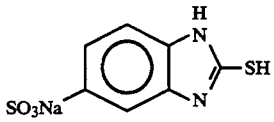

(49)

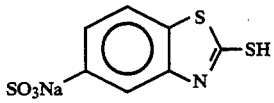

(50)

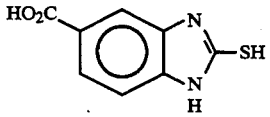

(51)

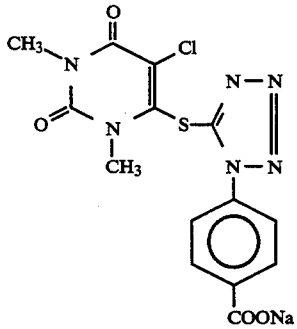

Among these, Compounds (1), (2), (9), (11), (12), (17), (23), (27), (28), (30), (31), (46), (49), and (51) are preferred.

The compound represented by formula (I) according to the present invention may be incorporated in an emulsion layer, a subbing layer, a protective layer, an interlayer, a filter layer, an antihalation layer or any other hydrophilic colloidal layers (preferably, a light-insensitive hydrophilic colloidal layer).

The time in which the compound represented by formula (I) according to the present invention is added may be arbitrarily selected from the various stages in the preparation process, preferably immediately before coating.

The compound represented by formula (I) according to the present invention may be used in a wide range of amounts. Concretely, the amount of the compound (I) to be used is preferably in the range of $5\times10^{-3}$ to $1\times10^{-5}$ mol, particularly preferably $1\times10^{-3}$ to $2\times10^{-4}$ mol per mol of silver.

Two or more compounds represented by formula (I) according to the present invention may be used in combination if desired.

Other various additives which can be used in the photographic material according to the present invention are not specifically limited. For examples, the additives shown below may be used.

| Item | Reference |
|---|---|
| 1) Silver halide emulsion and its preparation method | 6th-line from the bottom lower right column, - line 12, upper right column, page 10 of JP-A-2-68539; line 10, lower right column, page 2 - line 1, upper right column, page 6, and line 16, upper left column, page 10 - line 19, lower left column, page 11 of JP-A-3-24537; JP-A-4-107442 |
| 2) Chemical sensitization method | Line 13, upper right column - line 16, upper left column, page 10 of JP-A-2-68539; Japanese Patent Application No. 3-105035 |
| 3) Antifogging agent, Stabilizer | Line 17, lower left column, page 10 - line 7, upper left column, page 11, and line 2, lower left column, page 3 - lower left column, page 4 of JP-A-2-68539 |
| 4) Tone improver | Line 7, lower left column, page 2 - line 20, lower left column, page 10 of JP-A-62-276539; line 15, lower left column, page 6 - line 19, upper right column, page 11 of JP-A-3-94249 |
| 5) Spectral sensitizing dye | Line 4, lower right column, page 4 - lower right column, page 8 of JP-A-2-68539 |
| 6) Surface active agent, Antistatic agent | Line 14, upper left column, page 11 - line 9, upper left column, page 12 of JP-A-2-68539 |
| 7) Matting agent, Lubricant, Plasticizer | Line 10, upper left column - line 10, upper right column, page 12, and line 10, lower left column - line 1, lower right column, page 14 of JP-A-2-68539 |
| 8) Hydrophilic colloid | Line 11, upper right column - line 16, lower left column, page 12 of JP-A-2-68539 |
| 9) Hardener | Line 17, upper right column, page 12 - line 6, upper right column, page 13 of JP-A-2-68539 |
| 10) Support | Line 7 - line 20, upper right column, page 13 of JP-A-2-68539 |
| 11) Crossover cutting method | Line 20, upper right column, page 4 - upper right column, page 14 of JP-A-2-264944 |
| 12) Dye, Mordant | Line 1, lower left column, page 13 - line 9, lower left column, page 14 of JP-A-2-68539; lower left column, page 14 - lower right column, page 14 of JP-A-3-24539 |
| 13) Polyhydroxybenzenes | Upper left column, page 11 - lower left column, page 12 of JP-A-3-39948; EP 452772A |
| 14) Layer constitution | JP-A-3-198041 |
| 15) Development | Line 7, upper right column, page 16 - line 15, lower left column, page 19 of JP-A-2-103037; line 5, lower right column, page 3 - line 10, upper right column, page 6 of JP-A-2-115837 |

The present invention exerts a good effect on normal processing. In particular, the present invention can exert a great effect on processing in a low waste liquid environmental protection type automatic developing machine which operates in an amount of development replenisher (i.e., a developer replenishment ratio) of not more than 25 ml (particularly preferably from 5 to 20 ml) per quarter size (10×12 in.). In a particularly preferred embodiment of the present invention, processing is effected in a manner such that the processing time and the replenishment rate satisfy the following formula (A):

$$300 \leqq S\times T = 1{,}000 \qquad \text{(A)}$$

wherein S represents a developer replenishment rate (ml) per quarter size sheet (10×12 in.); and T represents a dry-to-dry processing time (sec.).

The fixing solution replenisher is preferably not more than 25 ml (particularly preferably from 5 to 20 ml).

The purpose of the photographic material according to the present invention is not specifically limited. The photographic material according to the present invention can be mainly used as a general black-and-white single-sided photographic material. The photographic material according to the present invention is preferably used for a system in which X-rays or other radiations transmitted by an object such as human body are converted to visible light which is then used for exposure, such as X-ray film for direct picture taking, X-ray film for indirect picture taking and CRT film. Examples of such a system include medical or industrial X-ray photographic material, X-ray dupe photographic material, and photographic material for medical CRT image.

The present invention will be further described in the following examples, but the present invention should not be construed as being limited thereto.

EXAMPLE

Preparation of Emulsion

To a solution of 6.2 g of gelatin (average molecular weight: 15,000) and 6.9 g of potassium bromide dissolved in 1 l of water which had been kept at a temperature of 40° C. were added an aqueous solution of 4.0 g of silver nitrate and an aqueous solution of 5.9 g of potassium bromide by a double jet method with stirring for 37 seconds. Subsequently, to the solution was added an aqueous solution of 18.6 g of gelatin. An aqueous solution of 9.8 g of silver nitrate was further then added to the resulting solution for 22 minutes while being heated to a temperature of 60° C. To the solution was then added 5.9 ml of a 25% aqueous ammonium solution. After 10 minutes, to the resulting solution was added an aqueous solution of 5.5 g of acetic acid. Subsequently, to the solution were added an aqueous solution of 151 g of silver nitrate and an aqueous solution of potassium bromide by a controlled double jet method for 35 minutes while the pA value thereof was kept to 8.8. During this process, the flow rate was accelerated so that the flow rate at the end of addition was 14 times that at the beginning of addition. After the addition was completed, to the solution was added 15 ml of a 2N potassium thiocyanate solution. Thereafter, the solution was cooled to a temperature of 35° C. wherein it was then subjected to sedimentation to remove soluble salts therefrom. The solution was heated to a temperature of 40° C. where 35 g of gelatin, 85 mg of proxel and a thickening agent were added thereto. The solution was then adjusted with caustic soda, potassium bromide and an aqueous solution of silver nitrate to a pH value of 6.1 and a pAg value of 7.8. The solution was heated to a temperature of 56° C. wherein 3 mg of sodium ethylthiosulfonate was added thereto. Finely divided grains of AgI having a diameter of 0.07 μm were then added to the solution in an amount of 0.1 mol% based on the total amount of silver. Thereafter, to the solution were added 0.04 mg of thiourea dioxide, and then 198 mg of 4-hydroxy-6-methyl-1,3,3a,7-tetrazaindene and 426 mg of Dye-I. After 10 minutes, to the solution were added a selenium compound-I, sodium thiosulfate, potassium thiocyanate and chloroauric acid in an amount of $0.52\times10^{-5}$ mol/molAg $1.03\times10^{-5}$ mol/molAg, 30 mg and 6 mg, respectively, and then the resulting solution was subjected to ripening for 50 minutes. The solution was then rapidly cooled to give a solidified material as Emulsion A. The emulsion thus obtained comprised grains having an aspect ratio of not less than 3 and grains having an aspect ratio of not less than 4 in a proportion of 93% and 65% of the total projected area of all grains, respectively. All grains having an aspect ratio of not less than 3 had an average diameter of 0.83 μm with a standard deviation of 15% as calculated in terms of projected area, an average thickness of 0.14 μm and an average aspect ratio of 6.2.

To a solution of 31.7 g of gelatin (average molecular weight: 70,000), 3.2 g of sodium p-methylphenylsulfinate tetrahydrate, 5.3 mg of sodium thiosulfate and 1.1 g of acetic acid dissolved in 860 ml of water which had been kept to a temperature of 55° C. were added 4.8 ml of a 25% aqueous ammonia, and then 2.5 ml of a 1% aqueous solution of silver nitrate and 8 ml of a 1% aqueous solution of potassium bromide with stirring. Subsequently, to the solution were added an aqueous solution of 165 g of silver nitrate and an aqueous solution of potassium bromide by a controlled double jet method for 60 minutes while the pA value thereof was kept to 7.8 and the flow rate of silver nitrate was kept constant. After the addition was completed, to the solution was added 15 ml of a 2N potassium thiocyanate solution. Thereafter, the solution was cooled to a temperature of 35° C. where it was then subjected to sedimentation to remove soluble salts therefrom. The solution was heated to a temperature of 40° C. wherein 35 g of gelatin, 85 mg of proxel and a thickening agent were added thereto. The solution was then adjusted with caustic soda, potassium bromide and an aqueous solution of silver nitrate to a pH value of 6.1 and a pAg value of 7.8. The solution was heated to a temperature of 56° C. wherein finely divided grains of AgI having a diameter of 0.07 gm were then added to the solution in an amount of 0.1 mol% based on the total amount of silver. Thereafter, to the solution were added 0.04 mg of thiourea dioxide, and then 198 mg of 4-hydroxy-6-methyl-1,3,3a,7-tetrazaindene and 426 mg of Dye-I. After 10 minutes, to the solution were added Selenium Compound-I, sodium thiosulfate, potassium thiocyanate and chloroauric acid in an amount of $0.52\times10^{-5}$ mol/molAg, $1.03\times10^{-5}$ mol/molAg, 30 mg and 6 mg, respectively, and then the resulting solution was subjected to ripening for 50 minutes. The solution was then rapidly cooled to give a solidified material as Emulsion B. The emulsion thus obtained comprised cubic grains having an average grain diameter of 0.55 μm with a standard deviation of 10%.

Dye-I

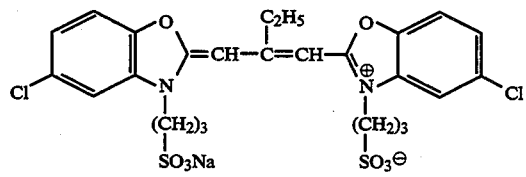

Selenium Compound-I

-continued

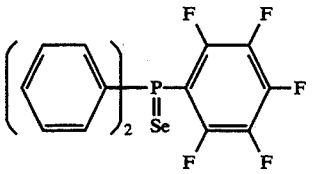

Preparation of Coating Solution for Emulsion Side

Emulsion layer coating solution

To Emulsion A and Emulsion B which had been chemically sensitized were added the following chemicals in amounts shown below (per mol of silver halide) to prepare Coating Solutions (a-1) and (a-2), respectively.

| | |
|---|---|
| 2,6-Bis(hydroxyamino)-4-diethylamino-1,3,5-triazine | 72.0 mg |
| Dextran (average molecular weight: 39,000) | 3.9 g |
| Potassium polystyrenesulfonate (average molecular weight: 600,000) | 0.7 g |
| Additive-I | 7.0 mg |
| Sodium hydroquinonemonosulfonate | 8.2 g |
| Snowtex C (manufactured by Nissan Chemical Industries, Ltd.) | 10.5 g |
| Copolymer latex of acrylic acid ester and methacrylic acid (ratio: 97/3 by weight) | 9.7 g |
| Gelatin to make | 2.6 g/m$^2$ (coated amount of emulsion layer) |
| Hardener (1,2-bis(vinylsulfonyl-acetamide)ethane) to make | 230% swelling ratio |

Coating Solution (a-3) was prepared in the same manner as described above except that Additive-I was not added.

Additive-I

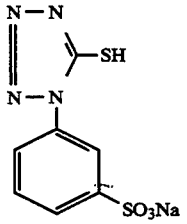

Preparation of Surface Protective Layer Coating Solution

Coating Solution (b-1) was prepared from the following components in such the manner that the coated amounts thereof reached the values given below:

| | |
|---|---|
| Gelatin | 650 mg/m$^2$ |
| Sodium polyacrylate (average molecular weight: 400,000) | 18 mg/m$^2$ |
| Copolymer of butyl acrylate and methacrylic acid (ratio: 6/4 by weight, average molecular weight: 120,000) | 120 mg/m$^2$ |
| Coating Aid-I | 18 mg/m$^2$ |
| Coating Aid-II | 45 mg/m$^2$ |
| Coating Aid-III | 0.9 mg/m$^2$ |
| Coating Aid-IV | 0.61 mg/m$^2$ |
| Coating Aid-V | 26 mg/m$^2$ |
| Additive-II | 1.3 mg/m$^2$ |
| Polymethyl methacrylate | 87 mg/m$^2$ |

-continued

| | |
|---|---|
| (average grain diameter: 2.5 μm) | |
| Proxel | 0.5 mg/m$^2$ |
| Potassium polystyrenesulfonate (average molecular weight: 600,000) | 0.9 mg/m$^2$ |
| pH (adjusted with NaOH) | 7.4 |

Coating Solution (b-2) was prepared in the same manner as described above except that Additive-III was added instead of Additive-II in the equimolecular amount. Coating Solution (b-3) was prepared in the same manner as described above except that neither Additive-II nor Additive-III was used.

Coating Aid-I

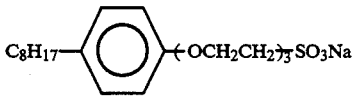

Coating Aid-II $C_{16}H_{33}O-(CH_2CH_2O)_{10}-H$

Coating Aid-III $C_8F_{17}SO_2N(C_3H_7)-(CH_2CH_2O)_{16}-H$

Coating Aid-IV $C_8F_{17}SO_2N(C_3H_7)-(CH_2CH_2O)_4-(CH_2)_4SO_3Na$

Additive-II

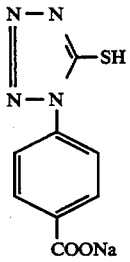

Proxel

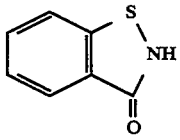

Coating Aid-V

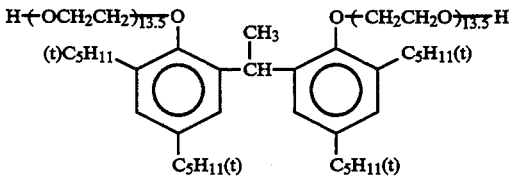

Additive-III

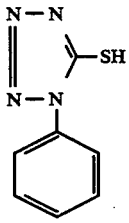

Preparation of Coating Solution for Back Side

Backing layer (1) Preparation of Dye Dispersion L

A solution of 2.5 g of the following dye-I and 2.5 g of the following Oil-I and Oil-II dissolved in 50 ml of ethyl acetate was mixed with 90 g of a 8% aqueous solution of gelatin containing 1.5 g of sodium dodecylbenzenesulfonate and 0.18 g of methyl p-hydroxybenzoate at a temperature of 60° C. The mixture was stirred at a high speed by a homogenizer. After stirred at a high speed, the material was then processed at a temperature of 60° C. under reduced pressure using an evaporator to remove 92% by weight of ethyl acetate therefrom. As a result, Dye Dispersion L having an average grain diameter of 0.18 μm was obtained.

(2) Preparation of Coating Solution

Coating Solution (c-1) was prepared from the following components in such the manner that the coated amount thereof reached the values given below:

| | |
|---|---|
| Gelatin | 2.0 g/m$^2$ |
| Phosphoric acid | 5.2 mg/m$^2$ |
| Snowtex C (Nissan Chemical Industries, Ltd.) | 0.5 g/m$^2$ |
| Copolymer latex of ethyl acrylate and methacrylic acid (ratio: 97/3 by weight) | 0.5 g/m$^2$ |
| Proxel | 4.2 mg/m$^2$ |
| Dye Dispersion L | 8.0 g/m$^2$ |
| Dye-II | 75 mg/m$^2$ |
| Dye-III | 27 mg/m$^2$ |
| Dye-IV | 23 mg/m$^2$ |
| Hardener (1,2-bis(vinylsulfonylacetamide) ethane | 40 mg/m$^2$ |

Dye-I

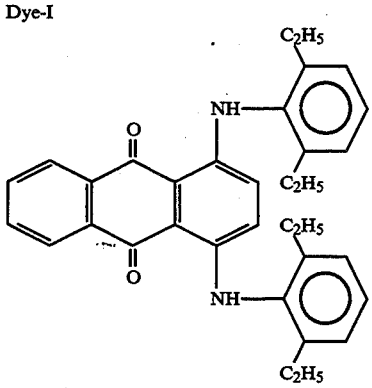

Dye-II

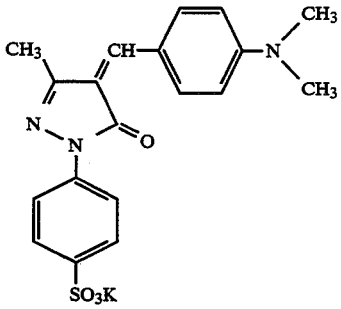

Dye-III

-continued

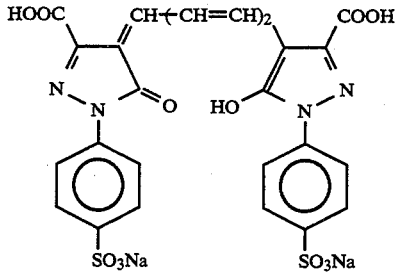

Dye-IV

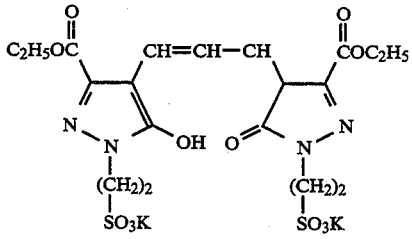

Oil-I

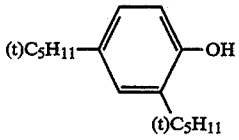

Oil-II

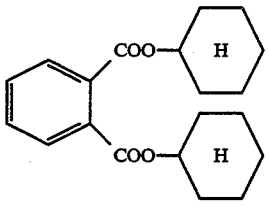

Surface Protective Layer

The coating solutions were prepared from the following components in such the manner that the coated amounts reached the values given below:

| | |
|---|---|
| Gelatin | 1,000 mg/m$^2$ |
| Polymethyl methacrylate (average grain diameter r: μm) | w |
| (average grain diameter 0.75 μm) | 81 mg/m$^2$ |
| Coating Aid-I | 20 mg/m$^2$ |
| Coating Aid-II | 40 mg/m$^2$ |
| Coating Aid-III | 6 mg/m$^2$ |
| Coating Aid-IV | 9 mg/m$^2$ |
| Coating Aid-VI | 1.7 mg/m$^2$ |
| Coating Aid-VII | 13 mg/m$^2$ |
| Proxel | 1.3 mg/m$^2$ |
| Potassium polystyrenesulfonate (average molecular weight: 600,000) | 2 mg/m$^2$ |
| NaOH | 2.5 mg/m$^2$ |

coating Solutions (d-1) to (d-5) were prepared using a matting agent having an average grain diameter of r in an amount w shown in Table 1.

Coating Aid-VI $C_8F_{17}SO_3K$

Coating Aid-VII

-continued

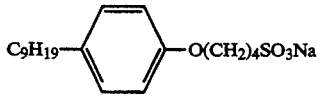

TABLE 1

| Coating Solution | r/μm | w/mg · m$^{-2}$ |
|---|---|---|
| (d-1) | 3.5 | 80 |
| (d-2) | 4.8 | 60 |
| (d-3) | 4.8 | 80 |
| (d-4) | 6.6 | 15 |
| (d-5) | 6.6 | 30 |

Preparation of Support

A 183-μm thick polyethylene terephthalate film which had been biaxially oriented was corona-discharged. The polyethylene terephthalate film was then coated on one side thereof with a first undercoating solution having the following composition by means of a wire bar coater in an amount of 5.1 ml/m$^2$. The coating solution was then dried at a temperature of 175° C. for 1 minute.

The other side of the polyethylene terephthalate film was similarly coated with a first undercoating solution. The polyethylene terephthalate film used comprised Dye-I in an amount of 0.04 wt %.

| | |
|---|---|
| Butadiene-styrene copolymer latex solution (solid content: 40% by weight; butadiene/styrene weight ratio: 31/35) | 79 ml |
| 4% Aqueous solution of sodium 2,4-Dichloro-6-hydroxy-s-triazine | 20.5 ml |
| Distilled water | 900.5 ml |

The latex solution comprised the following emulsion dispersant in an amount of 0.4 wt % based on the solid content of latex:

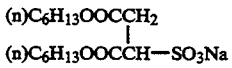

Preparation of Photographic Material

Onto one side of the support thus prepared were then coated the foregoing back side antihalation layer and surface protective layer. Onto the other side of the support were coated the emulsion layer and surface protective layer by a simultaneous extrusion method to give a combination of coating on both sides as shown in Table 2 to prepare Photographic Materials 1 to 9. The coated amount of silver on the emulsion side was 2.8 g/m$^2$.

TABLE 2

| | Emulsion side | | Back side | |
|---|---|---|---|---|
| Photographic Material | Emulsion Layer | Surface Protective Layer | Backing Layer | Surface Protective Layer |
| 1 | (a-1) | (b-1) | (c-1) | (d-1) |
| 2 | (a-1) | (b-1) | (c-1) | (d-2) |
| 3 | (a-1) | (b-1) | (c-1) | (d-3) |
| 4 | (a-1) | (b-1) | (c-1) | (d-4) |
| 5 | (a-1) | (b-1) | (c-1) | (d-5) |
| 6 | (a-2) | (b-1) | (c-1) | (d-1) |
| 7 | (a-2) | (b-1) | (c-1) | (d-5) |
| 8 | (a-3) | (b-2) | (c-1) | (d-5) |

TABLE 2-continued

| | Emulsion side | | Back side | |
|---|---|---|---|---|
| Photographic Material | Emulsion Layer | Surface Protective Layer | Backing Layer | Surface Protective Layer |
| 9 | (a-3) | (b-3) | (c-1) | (d-5) |

Processing-1

Automatic Developing Machine

The drive motor and gear of CEPROS-M manufactured by Fuji Photo Film Co., Ltd. were modified to increase the conveying speed.

| <Concentrated developer> | |
|---|---|
| Potassium hydroxide | 56.6 g |
| Sodium sulfite | 200 g |
| Diethylenetriaminepentaacetic acid | 6.7 g |
| Potassium carbonate | 16.7 g |
| Boric acid | 10 g |
| Hydroquinone | 83.3 g |
| Diethylene glycol | 40 g |
| 4-Hyroxymethyl-4-methyl-1-phenyl-3-pyrazolidone | 22 g |
| 5-Methylbenzotriazole | 2 g |
| Processing Aid-I | 0.6 g |
| Water to make | 1 l |
| (pH adjusted to 10.60) | |

Processing Aid-I

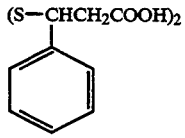

| <Concentrated Fixing Solution> | |
|---|---|
| Ammonium thiosulfate | 560 g |
| Sodium sulfite | 60 g |
| Disodium ethylenediaminetetraacetate dihydrate | 0.1 g |
| Sodium hydroxide | 24 g |
| Water to make | 1 l |
| (pH adjusted with acetic acid to 5.10) | |

Before the development was started, the various tanks in the automatic developing machine were filled with the processing solutions as follows:

Development tank: 333 ml of the foregoing concentrated developer, 667 ml of water and 10 ml of a starter containing 2 g of potassium bromide and 1.8 g of acetic acid were mixed to make a pH value of 10.25.

Fixing tank: 200 ml of the foregoing fixing solution and 800 ml of water

Processing speed: adjusted to 30 seconds between dry and dry

Development temperature: 35° C.

Fixing temperature: 35° C.

Drying temperature: 45° C.

Replenishment rate:

Developer: 22 ml/10×12 in.

Fixing solution: 30 ml/10×12 in.

Processing-2

Processing-2 was the same as Processing-1 except that the replenishment rate was changed to 20 ml/10×12 in., for the developer and 25 ml/10×12 in., for the fixing solution.

Processing-3

Automatic Developing Machine

Same as Processing-1

| <Developer Replenisher> | |
|---|---|
| Potassium hydroxide | 28.0 g |
| Sodium sulfite | 75.0 g |
| Diethylenetriaminepentaacetic acid | 2.0 g |
| Sodium carbonate | 30.0 g |
| Hydroquinone | 18.0 g |
| Diethylaminoethyl-5-mercaptotetrazole | 0.1 g |
| Potassium bromide | 1.0 g |
| Triethylene glycol | 6.0 g |
| 5-Nitroindazole | 0.3 g |
| Acetic acid | 40.0 g |
| Processing Aid-I | 0.2 g |
| Water to make | 1 l |
| (pH adjusted with sodium hydroxide to 10.3) | |
| <Fixing Solution Replenisher> | |
| Ammonium thiosulfate | 96.4 g |
| Disodium ethylenediaminetetraacetate dihydrate | 0.025 g |
| Sodium metabisulfite | 22.0 g |
| Water to make | 1 l |
| (pH adjusted with sodium hydroxide to 5.0) | |

Before the development was started, the various tanks in the automatic developing machine were filled with the processing solutions as follows:

Development tank: To 1 l of the foregoing developer replenisher were added 4.0 g of potassium bromide and 3.5 g of acetic acid.

Fixing tank: 1 l of the foregoing fixing solution replenisher

Processing speed: adjusted to 45 seconds between dry and dry

Development temperature: 35° C.

Fixing temperature: 32° C.

Drying temperature: 45° C.

Replenishment rate:

Developer: 15 ml/10×12 in.

Fixing solution: 20 ml/10×12 in.

Evaluation of Photographic Properties

The photographic material was exposed on its emulsion side to light from CRT for medical multicamera (illuminant: P-45) in such the manner that illumination was conducted with a density gradient for 1 second, and then subjected to the foregoing processing for the evaluation of sensitivity. Sensitivity was represented by the reciprocal of the ratio of the exposure giving a density of fog plus 1.0 to that of Photographic Material 1 obtained by Processing-III as standard.

Evaluation of Conveyability

The photographic material was slit into 30.5 cm×25.4 cm strips which were then allowed to stand at a temperature of 25° C. and 60% RH for 3 hours. These specimens were then subjected to conveyability test (conveyance was made 100 times) by means of an RN autofeeder (produced by Fuji Photo Film Co., Ltd.). Conveyability was evaluated by the number of sheets which had been excessively conveyed.

Evaluation of Abrasion Resistance

The photographic material was provided with round corners. The photographic material was then slit into 30.5 cm×25.4 cm strips. 10 sheets of the respective specimen were put into a 35.1 cm×26.9 cm×3.0 cm decorative box. The decorative box was then shaken 100 times. These specimens were developed and visually evaluated for the degree of abrasion (blackening) in accordance with the following criteria:

E . . . Little or no scratch

G . . . Slight but unappreciable scratch

F . . . Practically allowable scratch

P . . . Much unallowable scratch

Evaluation of Unevenness in Dye Transfer

The photographic material was moisture-controlled to a temperature of 25° C. and 70% RH, and then sealed in a moistureproof bag. The bag was then aged at a temperature of 50° C. under a weight pressure of 4 kg/m$^2$ for 10 days. The bag was then opened for visual evaluation of transfer of dye to the emulsion surface. Another batch of the photographic material which had been similarly aged was exposed on its emulsion side to light from CRT for medical multicamera (illuminant: P-45) in such the manner that illumination was conducted to give a density of 1.0 for 1 second, and then subjected to the foregoing processing for visual evaluation of density unevenness in accordance with the following criteria.

E . . . Little or no transfer

G . . . Slight transfer but no density unevenness after development

F . . . Practically allowable density unevenness after development

P . . . Unallowable vigorous density unevenness after development

Evaluation of Natural Ageing Stability

The coated specimen was aged in a sealed container which had been kept to a temperature of 50° C. and 68% RH inside for 5 days (forced ageing). The specimen thus aged and a comparative specimen (stored in a light-shielded container at room temperature) were subjected to the same processing as effected in the evaluation of photographic properties, and then measured for the density of fogged area. Natural ageing resistance was evaluated by percent fogging.

$$(\textit{Percent fogging increase}) = [(\textit{fog increase upon forced ageing})/\{(\textit{maximum density}) - (\textit{support density})\}] \times 100$$

The lower the fogging percent is, the better is the natural ageing resistance.

The results of the evaluation of these performances made on Photographic Material Specimens 1 to 9 are shown in Table 3. The photographic material specimens according to the present invention were confirmed to be excellent in sensitivity, conveyability, abrasion resistance, dye transfer evenness and natural ageing resistance. In particular, the photographic material specimens comprising the Additive-I and Additive-II provided markedly excellent results in sensitivity and natural ageing resistance.

TABLE 3

| Photographic Material | Sensitivity Processing I | Sensitivity Processing II | Sensitivity Processing III | Beck smoothness (sec.) | Conveyability | Abrasion resistance | Transfer unevenness | Preservability | |
|---|---|---|---|---|---|---|---|---|---|
| 1 | 118 | 102 | 100 | 412 | 40 | E | F | 0 | Comparison |
| 2 | 120 | 101 | 102 | 184 | 11 | E | G | 0 | Comparison |
| 3 | 121 | 100 | 101 | 141 | 0 | E | G | 0 | Invention |
| 4 | 115 | 103 | 100 | 256 | 18 | E | G | 0 | Comparison |
| 5 | 120 | 100 | 101 | 118 | 0 | E | E | 0 | Invention |
| 6 | 103 | 61 | 65 | 420 | 42 | G | F | 12 | Comparison |
| 7 | 99 | 58 | 66 | 112 | 0 | P | E | 11 | Comparison |
| 8 | 104 | 98 | 97 | 114 | 0 | G | E | 1 | Invention |
| 9 | 125 | 114 | 118 | 115 | 0 | E | E | 5 | Invention |

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising (i) at least one silver halide emulsion layer on a support and a backing layer on the surface of the support opposite to the emulsion layer, wherein said silver halide emulsion layer comprises tabular grains having an aspect ratio of not less than 3 in a proportion of not less than 50% as calculated in terms of projected area of the silver halide grains contained in the emulsion layer and the surface on the backing layer side has a Beck smoothness of not more than 150 seconds, and (ii) a matting agent having a grain diameter of 6 μm to less than 12 μm.

2. The silver halide photographic material as in claim 1, wherein at least one layer on the light-sensitive silver halide emulsion layer side contains a compound represented by formula (I):

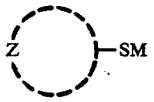

wherein Z represents a heterocyclic ring directly or indirectly having at least one group selected from the group consisting of $—SO_3M$, —COOM, $—CONHR^1$, $—SO_2NHR^2$, —OH and $—NHR^3$; M represents a hydrogen atom, an alkaline metal atom, a quaternary ammonium group or a protective group which is released under an alkaline conditions; $R^1$, $R^2$ and $R^3$ each represents a hydrogen atom, an alkyl group having 1 to 6 carbon atoms, $—COR^4$, $—COOR^4$ or $—SO_2R^4$; and $R^4$ represents a hydrogen atom, an aliphatic group or an aromatic group.

3. The silver halide photographic material as in claim 1, wherein said silver halide emulsion is subjected to selenium or tellurium sensitization.

4. The silver halide photographic material as in claim 1, wherein the surface on the emulsion layer side has a Beck smoothness of not less than 1,000 seconds.

5. The silver halide photographic material as in claim 1, wherein said silver halide grains have an average aspect ratio of from not less than 3 to less than 20.

* * * * *